US007744249B2

(12) United States Patent
Yamamoto et al.

(10) Patent No.: US 7,744,249 B2
(45) Date of Patent: Jun. 29, 2010

(54) HIGH-PRESSURE DISCHARGE LAMP, LAMP UNIT AND IMAGE DISPLAY DEVICE

(75) Inventors: Masahiro Yamamoto, Osaka (JP); Syunsuke Ono, Osaka (JP); Minoru Ozasa, Kyoto (JP); Masaru Ikeda, Osaka (JP)

(73) Assignee: Panasonic Corporation, Osaka (JP)

( * ) Notice: Subject to any disclaimer, the term of this patent is extended or adjusted under 35 U.S.C. 154(b) by 609 days.

(21) Appl. No.: 11/722,984

(22) PCT Filed: Apr. 20, 2006

(86) PCT No.: PCT/JP2006/308355

§ 371 (c)(1),
(2), (4) Date: Jun. 27, 2007

(87) PCT Pub. No.: WO2006/115180

PCT Pub. Date: Nov. 2, 2006

(65) Prior Publication Data

US 2010/0027272 A1 Feb. 4, 2010

(30) Foreign Application Priority Data

Apr. 21, 2005 (JP) ..... 2005-124232

(51) Int. Cl.
*H05B 31/00* (2006.01)
*H01J 17/16* (2006.01)

(52) U.S. Cl. ..... 362/263; 362/262; 313/623; 313/631

(58) Field of Classification Search ..... 362/261, 362/262, 263, 538, 265, 341; 313/634, 623, 313/631, 625, 637, 607, 567
See application file for complete search history.

(56) References Cited

U.S. PATENT DOCUMENTS

| | | | | |
|---|---|---|---|---|
| 6,563,267 | B1 * | 5/2003 | Van Den Nieuwenhuizen et al. | 313/594 |
| 6,791,267 | B2 * | 9/2004 | Niimi | 313/634 |
| 7,329,992 | B2 * | 2/2008 | Minamihata et al. | 313/607 |
| 7,402,954 | B2 * | 7/2008 | Van Den Nieuwenhuizen et al. | 313/625 |
| 2004/0256991 | A1 * | 12/2004 | Minamihata et al. | 313/626 |
| 2005/0140295 | A1 * | 6/2005 | Van Den Nieuwenhuizen | 313/567 |
| 2007/0052364 | A1 * | 3/2007 | Van Den Nieuwenhuizen et al. | 313/634 |

FOREIGN PATENT DOCUMENTS

| | | |
|---|---|---|
| EP | 1 107 285 | 6/2001 |
| JP | 6-111764 | 4/1994 |
| JP | 10-31977 | 2/1998 |

(Continued)

*Primary Examiner*—Bao Q Truong

(57) ABSTRACT

The present invention provides a high-pressure discharge lamp having a long life.

A high-pressure discharge lamp (100) comprises a light emitting part (4); first and second sealing parts (6, 8); first and second electrodes (10, 11); a first conductive lead (21) wound around the first sealing part; a first lead wire (22) electrically connecting the first conductive lead to the first electrode; a second conductive lead (25) wound around the second sealing part; and a second lead wire (26) connecting the second conductive lead to the first electrode. The second lead wire detours the light emitting part to avoid being affected by heat.

After the lamp is turned off, the temperature of base parts of the electrodes immediately falls, and much mercury can be collected in the vicinities of the base parts.

7 Claims, 9 Drawing Sheets

FOREIGN PATENT DOCUMENTS

| | | |
|---|---|---|
| JP | 10-188896 | 7/1998 |
| JP | 2001-167737 | 6/2001 |
| JP | 2001-345076 | 12/2001 |
| JP | 2002-110100 | 4/2002 |
| JP | 2005-56599 | 3/2005 |

* cited by examiner

FIG.7A

| TOTAL LIGHTING TIME | 0h | 1000h | 1500h | 2000h | 2500h | 3000h | 4000h | 5000h | 6000h |
|---|---|---|---|---|---|---|---|---|---|
| CONVENTIONAL SPEC 1 | ○ | ○ | ○ | △ | △ | × | × | × | × |
| CONVENTIONAL SPEC 2 | ○ | ○ | △ | △ | × | × | × | × | × |
| CONVENTIONAL SPEC 3 | ○ | ○ | △ | △ | △ | × | × | × | × |
| NEW SPEC 1 | ○ | ○ | ○ | ○ | ○ | ○ | ○ | ○ | △ |
| NEW SPEC 2 | ○ | ○ | ○ | ○ | ○ | ○ | △ | △ | △ |
| NEW SPEC 3 | ○ | ○ | ○ | ○ | ○ | ○ | ○ | △ | △ |

※CONVENTIONAL RATED LIFE : 2000h

FIG.7B

○BREAKDOWN VOLTAGE DATA
・110W LAMP、n=20

| | CONVENTIONAL SPEC | NEW SPEC |
|---|---|---|
| Max. | 11.5kV | 7.5kV |
| Ave. | 6.3kV | 4.7kV |
| Ave.+3σ | 14.8kV | 9.9kV |

102

HIGH-PRESSURE DISCHARGE LAMP, LAMP UNIT AND IMAGE DISPLAY DEVICE

TECHNICAL FIELD

The present invention relates to a high-pressure discharge lamp, and a lamp unit and an image display apparatus that include the same.

BACKGROUND ART

Among high-pressure discharge lamps, high-pressure mercury lamps in which mercury is filled as a light emitting substance has recently been attracting attention as light sources for liquid crystal projectors.

In a high-pressure mercury lamp, a pair of electrodes extends into a discharge space such that the tips of the electrodes face each other with a distance therebetween. The lamp keeps lighting by causing an arc discharge between the pair of electrodes. At the start of the lighting, the arc discharge does not immediately occur between the tips of the electrodes. Instead, first a discharge occurs at the base of an electrode in the discharge space (hereinafter called the "the electrode base part"). The discharge transfers along the inner surface of the discharge vessel forming the discharge space, from the electrode base part of one of the electrodes to the electrode base part of the other one of the electrodes (or the tip of the other one of the electrodes).

The discharge that occurs at the base of an electrode is hereinafter called "the base discharge". The base discharge occurs because the temperature in the discharge space and the mercury vapor pressure between the tips of the electrodes are both low. After the base discharge occurs, the base of the electrode becomes an arc spot. The arc spot causes the material (tungsten) of the electrode to evaporate. The evaporated material attaches to and accumulates on the inner surface of the discharge vessel. The accumulation is called "blackening". The blackening on the inner surface of the discharge vessel leads to a short life of the lamp due to reduction in the luminous flux maintenance factor.

Japanese Laid-Open Patent Application Publication No. 10-188896 is an example of prior art documents relating to the invention of the present application.

Liquid crystal projectors having such a high-pressure mercury lamp in the past were used mainly in school classrooms, conference rooms, and the like, but in recent years have become increasingly popular with ordinary households.

The liquid crystal projectors used principally in school classrooms and conference rooms are in use for a maximum of a few hours each day. The projectors used as TV displays or home theaters, on the other hand, are used continuously. Hence, it can be assumed that a period of use is incomparably longer than that of the conventional mode of use. Consequently, the life (e.g. 2000 hours) of the projectors that were used mainly in the school classroom and conference rooms is insufficient, and a life several times that of previous lamps is required.

The liquid crystal projectors for use in ordinary households are required to be small and light for portability and easy setup.

DISCLOSURE OF THE INVENTION

The present invention is made in terms of the problem above. The object of the present invention is to provide a high-pressure discharge lamp that is small and light and can achieve a longer life than conventional high-pressure discharge lamps, and a lamp unit and an image display apparatus that include the high-pressure discharge lamp.

Means for Solving the Problem

To achieve the aforementioned object, the prevent invention provides a high-pressure discharge lamp comprising: a light emitting part having therein a discharge space; first and second sealing parts respectively disposed at both ends of the light emitting part; first and second electrodes respectively extending from the first and second sealing parts into the discharge space; a first winding part formed by winding a first conductive lead around the first sealing part, the first conductive lead being electrically connected to the first electrode; a second winding part formed by winding a second conductive lead around the second sealing part; and a lead wire that is electrically connected to and extends from the second winding part, detours around the light emitting part, and is connected to the first conductive lead.

Advantageous Effects of the Present Invention

With the stated structure, the heat is radiated from the first and second winding parts, and the temperature of the base parts of the electrodes immediately falls. Accordingly, much mercury can be collected in the vicinities of the base parts. As a result, it is possible to prevent the blackening of the arc tube due to the base discharge, and realize a long life of the lamp.

Also, since the conductive leads of the first and second winding parts are electrically connected to the first electrode, the breakdown voltage can be suppressed. As a result, it is possible to realize a lighting apparatus that is small and light.

Also, since the lead wire, electrically connected to the first electrode, detours the light emitting part, it is possible to prevent degradation of the lead wire due to the high temperature during the lighting.

Here, at least one of the first winding part and the second winding part may be a coil.

Here, a portion from a winding start to a winding end of the coil may be capacitive-coupled to the lead wire.

With the stated structure, it is possible to prevent that the high-voltage pulse applied at the start-up becomes hard to reach at the tips of the winding parts.

Here, the high-pressure discharge lamp may further comprise a holding member that is disposed on at least one of base parts of the first and second electrodes within the discharge space, and operable to hold mercury that gathers in a vicinity of the at least one of the base parts after the lamp is turned off.

Also, a lamp unit pertaining to the present invention is a lamp unit comprising: the high-pressure discharge lamp defined above; and a reflecting mirror that reflects light emitted from the high-pressure discharge lamp.

Also, an image display apparatus pertaining to the present invention is an image display apparatus comprising the high-pressure discharge lamp defined above.

BRIEF DESCRIPTION OF THE DRAWINGS

FIG. 7A is a table showing results of a lamp life test;

FIG. 7B is a table showing results of a breakdown voltage measuring test;

DESCRIPTION OF NUMBERING

Figure 1:
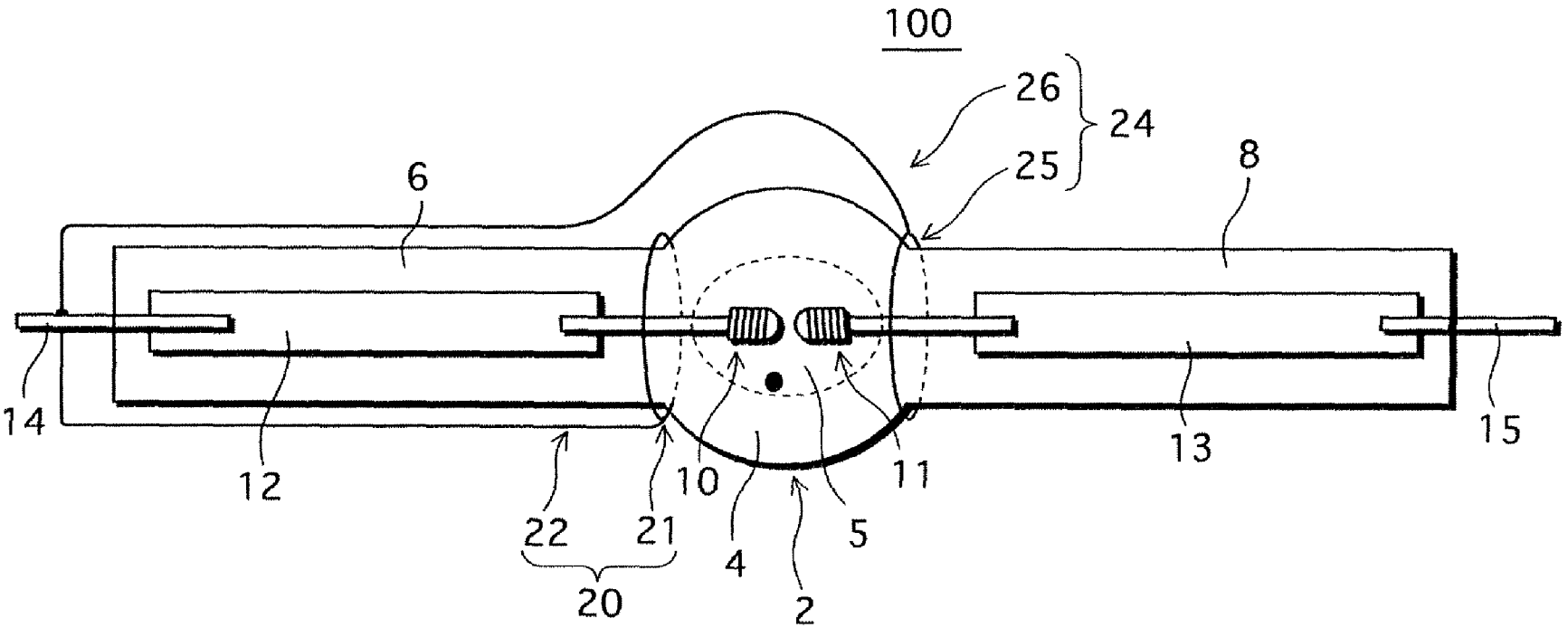
FIG. 1 shows an overall structure of a high-pressure mercury lamp 100 pertaining to the first embodiment with a rated power of 110 W.

2 Arc tube
4 Light emitting part
5 Discharge space
6 First sealing part
8 Second sealing part
10, 11 Electrode
14, 15 External lead
20, 24, 30, 35, 40 Conductor
21, 31 First winding part
25, 32 Second winding part
22, 26, 33, 37, 42 Lead
36, 41 Coil part
51 Liquid collecting member
53 Liquid collecting coil
100, 101, 102, 103 High-pressure mercury lamp
200 Lamp unit
400 Image display apparatus

BEST MODE FOR CARRYING OUT THE INVENTION

First Embodiment

The following describes embodiments of the present invention, with reference to the drawings.

(1) Structure of High-pressure Mercury Lamp

The following describes the structure of a high-pressure mercury lamp as an example of high-pressure discharge lamps.

FIG. 1 shows an overall structure of a high-pressure mercury lamp 100 with a rated power of 110 W.

As FIG. 1 shows, an arc tube 2 is made of silica glass, and includes a light emitting part 4 substantially in a spheroidal shape, and a first sealing part 6 and a second sealing part 8 respectively extending from both ends of the light emitting part 4. The first sealing part 6 and the second sealing part 8 extend to opposing directions substantially coaxially. Note that the light emitting part 4 may be substantially in a spherical shape or the like.

In a discharge space 5 formed within the light emitting part 4, electrodes 10 and 11 respectively projecting from the sealing parts 6 and 8 are disposed. The electrodes 10 and 11 are made of tungsten. The distance between the tips of the electrodes 10 and 11, namely the electrode gap distance, is set to be in a range of 0.5 mm to 2.0 mm inclusive.

The light emitting part 4 encloses therein mercury as a light emitting substance, argon (Ar), krypton (Kr), xenon (Xe) and the likes as rare gases for aiding start-up, and halogen substances such as iodine (I) and bromine (Br).

The quantity of enclosed mercury is set to be in a range of 150 mg/cm$^3$ to 650 mg/cm$^3$ per unit volume inclusive in the arc tube 2, and the pressure of the inert gas when the lamp is cool is set to be a range of 0.01 MPa to 1 MPa inclusive.

The halogen substance has a function of returning tungsten caused to evaporate from the electrodes 10 and 11 due to the high temperature when the lamp is operating to the electrodes 10 and 11 in a process known as the halogen cycle. As the halogen substance, bromine is enclosed for example, and the quantity of enclosed bromine is, for example, in a range of $1*10^{-10}$ mol/cm$^3$ to $1*10^{-4}$ mol/cm$^3$ inclusive.

The electrodes 10 and 11 are electrically connected with external leads 14 and 15 via metal foils 12 and 13 respectively. The external leads 14 and 15 are respectively led from the ends of the shielding parts 6 and 8 to outside the arc tube 2. The metal foils 12 and 13, and the external leads 14 and 15 are made of molybdenum, for example.

A first conductor 20 and a second conductor 24 are disposed around the arc tube 2.

The first conductor 20 includes a ring-shaped winding part 21 and a lead 22 connected therewith. The winding part 21 is formed by winding a lead around the first sealing part 6 near the light emitting part 4. The winding part 21 has a closed-loop structure. The winding part 21 is electrically connected with the external lead 14 extending from the end of the sealing part 6 via the lead 22 extending substantially straight along the side of the first sealing part 6.

The second conductor 24 includes a ring-shaped winding part 25 and a lead 26 connected therewith. The winding part 25 is formed by winding a lead around the second sealing part 8 near the light emitting part 4.

The lead 26 detours around the outer surface of the light emitting part 4, and extends substantially straight toward the shielding part 6 to electrically connect with the external lead 14.

Since the external lead 14 is electrically connected with the electrode 10, the first winding part 21 and the second winding part 25 are electrically connected with the electrode 10.

(2) Acts

The lamp 100 includes the winding parts 21 and 25 near the light emitting part 4. After the lamp 100 is turned off, the electrode base parts are rapidly cooled down due to the heat radiation from the winding parts 21 and 25. Therefore, the mercury tends to gather in the vicinity of the electrode base parts. Here, "the electrode base parts" are parts near the sealing parts 6 and 8, of the electrodes 10 and 11 projecting into the discharge space 5.

As described above, the blackening of conventional arts, occurring at the discharge start due to the base discharge, is caused because the electrode base parts become arc spots and a large amount of the electrode material evaporates.

In the lamp 100 on the other hand, more of the mercury gathers around the electrode base parts than conventional arts while the light is off. Accordingly, the base discharge occurring when the lamp 100 is lit up the next time acts on the mercury (instead of on the electrode material). This prevents that a large amount of the electrode material evaporates, unlike conventional arts.

Also, since it is possible to immediately evaporate the mercury gathered at the electrode base parts to increase the mercury vapor pressure, the base discharge immediately shifts to the discharge between the tips of the electrodes and the time period of the base discharge becomes short. This also prevents that a large amount of the electrode material evaporates.

As a result, it is possible to prevent the blackening of the arc tube due to the base discharge occurring at the start of the lighting, and this also results in a long life of the lamp.

Also, since the lamp 100 has the conductors 20 and 24, it is possible to reduce the break down voltage caused at the discharge start of the lamp. To generate a high voltage pulse to be applied to the lamp, it is necessary to use a large transformer, high-pressure-resistant electronic devices, and the likes in the lighting apparatus. Therefore, if the breakdown voltage can be reduced, it is possible to miniaturize the lighting apparatus. This is explained next with reference to FIG. 2.

Figure 2:
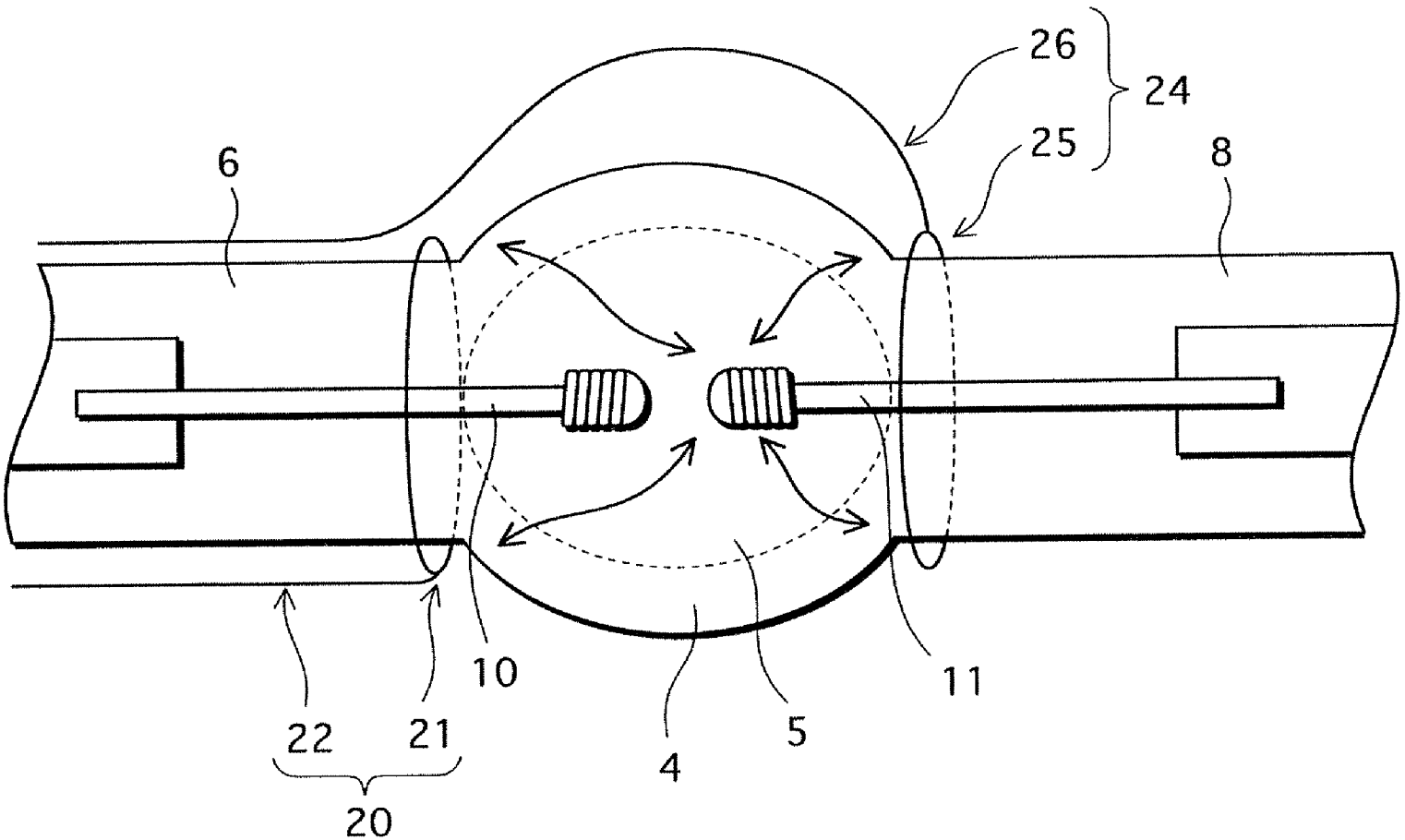
FIG. 2 schematically shows an electric field generated at the start of lighting of the lamp 100.

FIG. 2 schematically shows an electric field generated at the start of lighting of the lamp 100. In FIG. 2, areas where an electric field is generated between the electrode 11 and the conductors 20 and 24 are schematically illustrated as arrows.

When a voltage is applied to the lamp 100, a broad electric field across the whole discharge space 5 is generated between the electrode 11 and the conductors 20 and 24. This broad electric field activates the movement of more of the free electrons existing within the light emitting part 4, and the breakdown can be more easily performed between the electrode 10 and the electrode 11. As a result, it is possible to effectively start the discharge with a fairly low voltage pulse.

Again, FIG. 1 shows that the lead 26 detours around the outer surface of the light emitting part 4, and extends toward the shielding part 6.

The inventors of the present invention found by tests that if the led is close to the light emitting part, the lead gradually oxides due to the high temperature of the light emitting part that is turned on, and the lead breaks in some cases.

Such a problem can be prevented by setting the lead 26 to detour around the light emitting part 4 so as to be prescribed distance away from the light emitting part 4.

Note that an optimum distance between the lead 26 and the light emitting part 4 can be obtained by tests.

In this embodiment, both winding parts 21 and 25 are connected with the external lead 14 via the independent leads 22 and 26 respectively for making the implementation easy.

Moreover, since the winding parts 21 and 25 retain heat while the lamp 100 is turned on, they can rise the temperature of the electrode base parts which tend to have a relatively low temperature in the discharge space during the lighting, and also rise the cold spot temperature.

Positions of the Winding Parts

In this embodiment, the winding parts 21 and 25 are respectively located near the light emitting part 4, on the outer surfaces of the sealing parts 6 and 8. To effectively achieve the radiation effect and the breakdown voltage reduction effect described above, it is preferable that the winding parts 21 and 25 are respectively located near the light emitting part 4, on the outer surfaces of the sealing parts 6 and 8.

Number of Turns of Winding Parts

Regarding the radiation effect, the winding parts should respectively be wound near the sealing parts at least once. The radiation effect increases as the number of turns increases. However, as described above, the winding parts have an effect of rising the cold spot temperature while the lamp is turned on. Accordingly, too many turns excessively rise the electrode base parts, and increase the probability of the arc tube breakage.

To achieve both the effect of rising the temperature of the coolest point while the lamp is turned on and the radiation effect after the lamp is turned off, it is preferable that the winding parts are wound approximately 1-15 times. In the case of the lamp pertaining to this embodiment, particularly preferable results were obtained when the winding parts were wound 3-10 times.

(3) Structure of Lamp Unit

Figure 3:
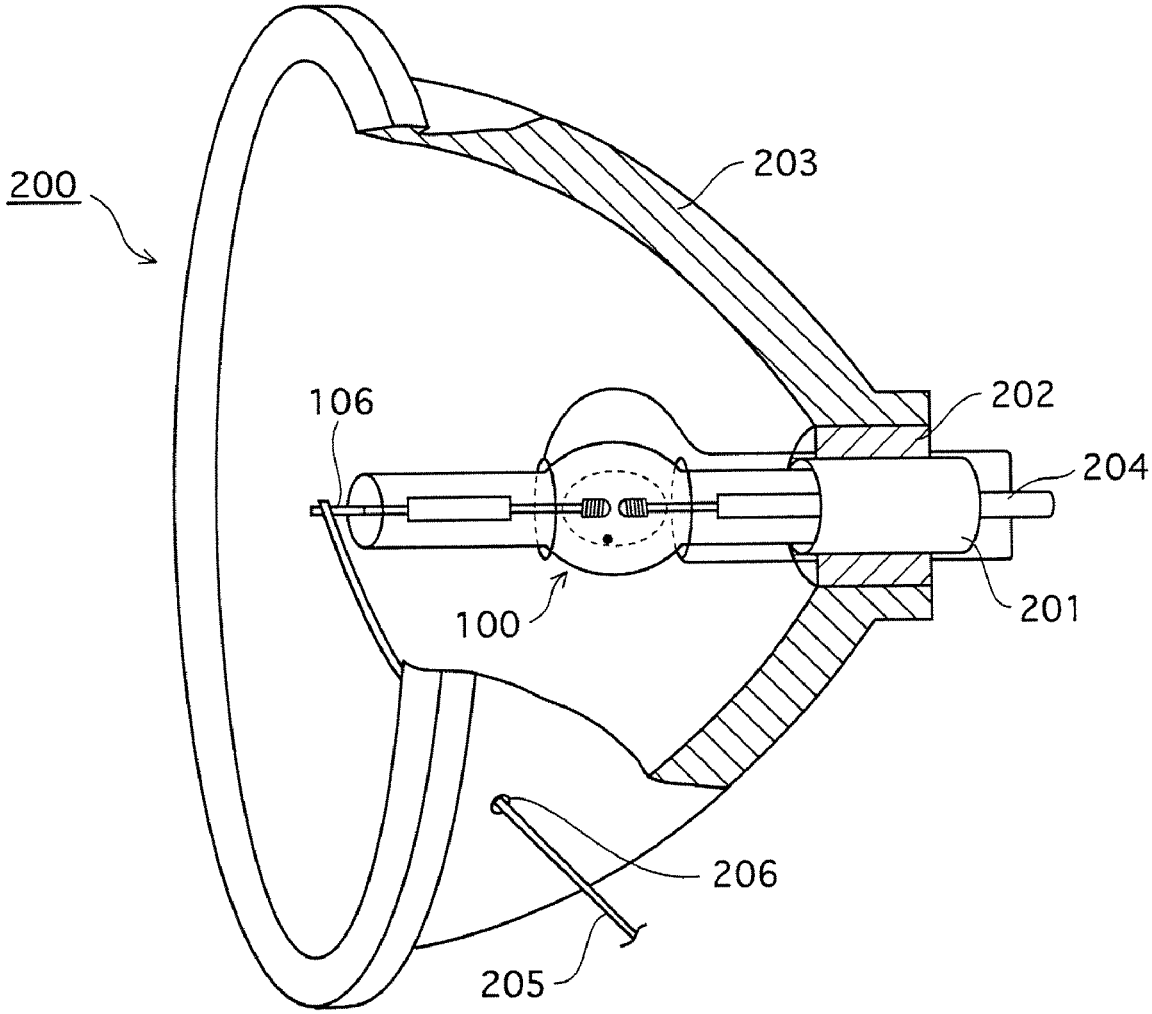
FIG. 3 is a perspective view with a cut-away section and shows the structure of a lamp unit 200.

FIG. 3 is perspective view with a cut-away section and shows the structure of part of the lamp unit 200.

The lamp unit 200 includes the lamp 100 and a high-pressure discharge lamp lighting device (not shown in FIG. 2) for causing the lamp 100 to light, and a concave mirror 203 as a reflector (a reflective material) for reflecting light emitted from the lamp 100.

One end of the arc tube 2 (See FIG. 1) has a base 201 fitted to it, and the lamp 100 is fitted into the concave mirror 203 via a spacer 202. This fitting involves adjusting the components in such a way that the length direction central axis of the arc tube 101 and the optical axis of the concave mirror 203 are substantially aligned, and the position of the discharge arc of the lamp 100 substantially matches the focal point of the concave mirror 203.

Power is supplied to the external lead 14 (see FIG. 1) of the base 201 side of the lamp 100 via a terminal 204. Power is supplied to the other external lead 15 via a lead 205 that passes to the exterior through a hole 206 pierced through the concave mirror 203.

(4) Structure of Liquid Crystal Display Apparatus

Figure 4:
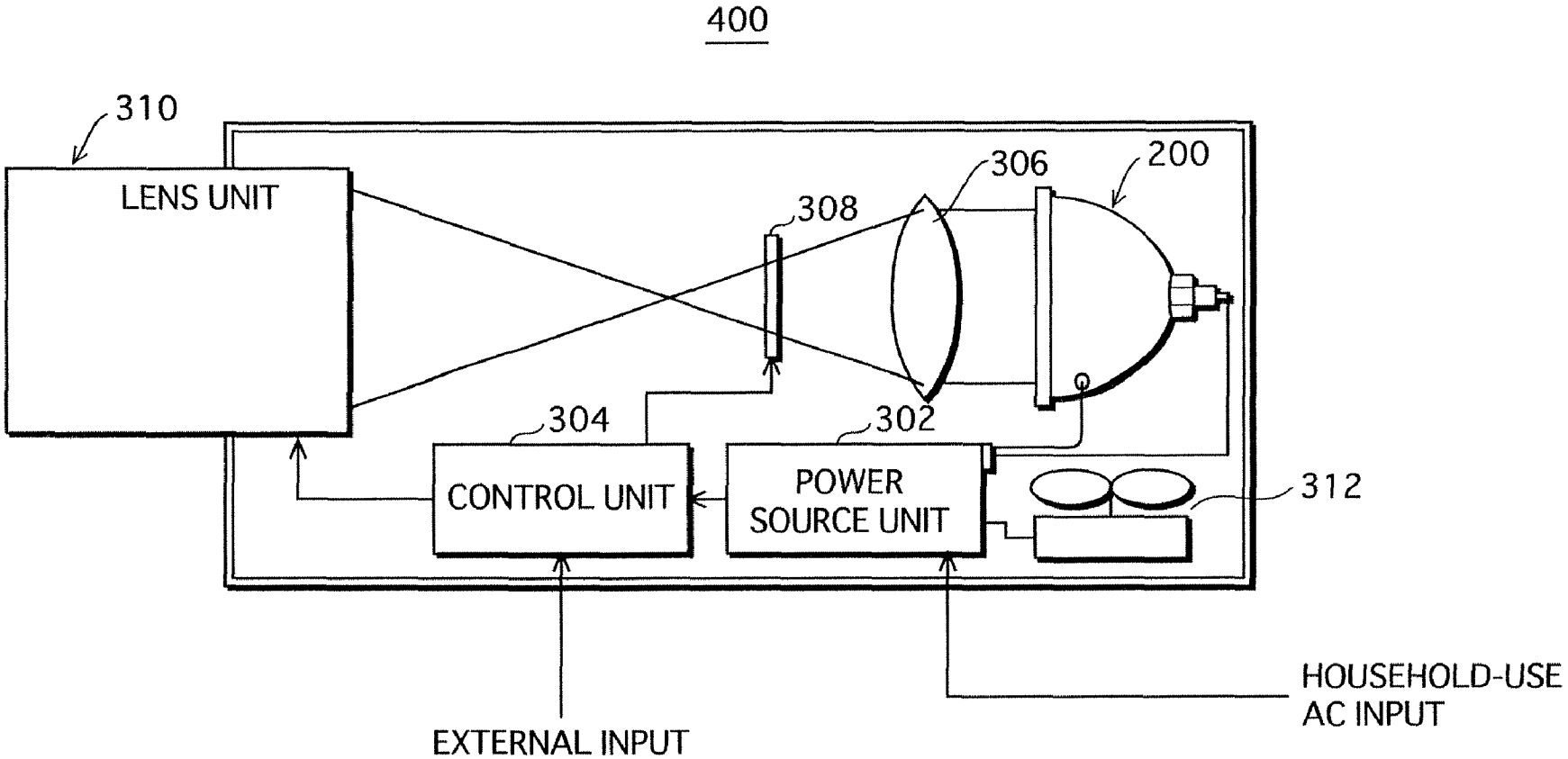
FIG. 4 shows the structure of a liquid crystal projector 400 as a liquid crystal display apparatus including the lamp unit 200.

FIG. 4 schematically shows the structure of a liquid crystal projector 400 as a liquid crystal display apparatus including the above-described lamp unit 200.

As shown in FIG. 4, the liquid crystal projector 400 is composed of a power source unit 302, a control unit 304, a condenser lens 306, a transmission-type color liquid crystal display panel 308, a lens unit 310 which contains a driving motor, and a fan device 312 for cooling purposes.

The power source unit 302 transforms household-use AC input (100V) to a predetermined DC voltage, and supplies the DC voltage to the control unit 304, the fan device 312 and so on described above.

The control unit 304 drives the color liquid crystal display panel 308, causing it to display color images based on image signals inputted from the exterior. Further, the control unit 304 controls the driving motor inside the lens unit 310, causing the lens unit 310 to execute focusing operations and zoom operations.

Light irradiated from the lamp unit 200 is condensed by the condenser lens 306, and transmitted through the color liquid crystal display panel 308, which is disposed in the optical path, and the image formed on the liquid crystal display panel 308 is thereby projected through the lens unit 310 and onto a screen not shown in FIG. 4.

Note that the lamp unit 200 can be applied in other general projector-type image display devices, such as DLP (registered trademark) style projectors that use DMDs (digital micro-mirror devices), liquid crystal projectors that use other reflection-type liquid crystal components, and the like.

Second Embodiment

In the second embodiment, the number of turns of the leads is increased to improve the radiation effect compared to the first embodiment.

Figure 5:
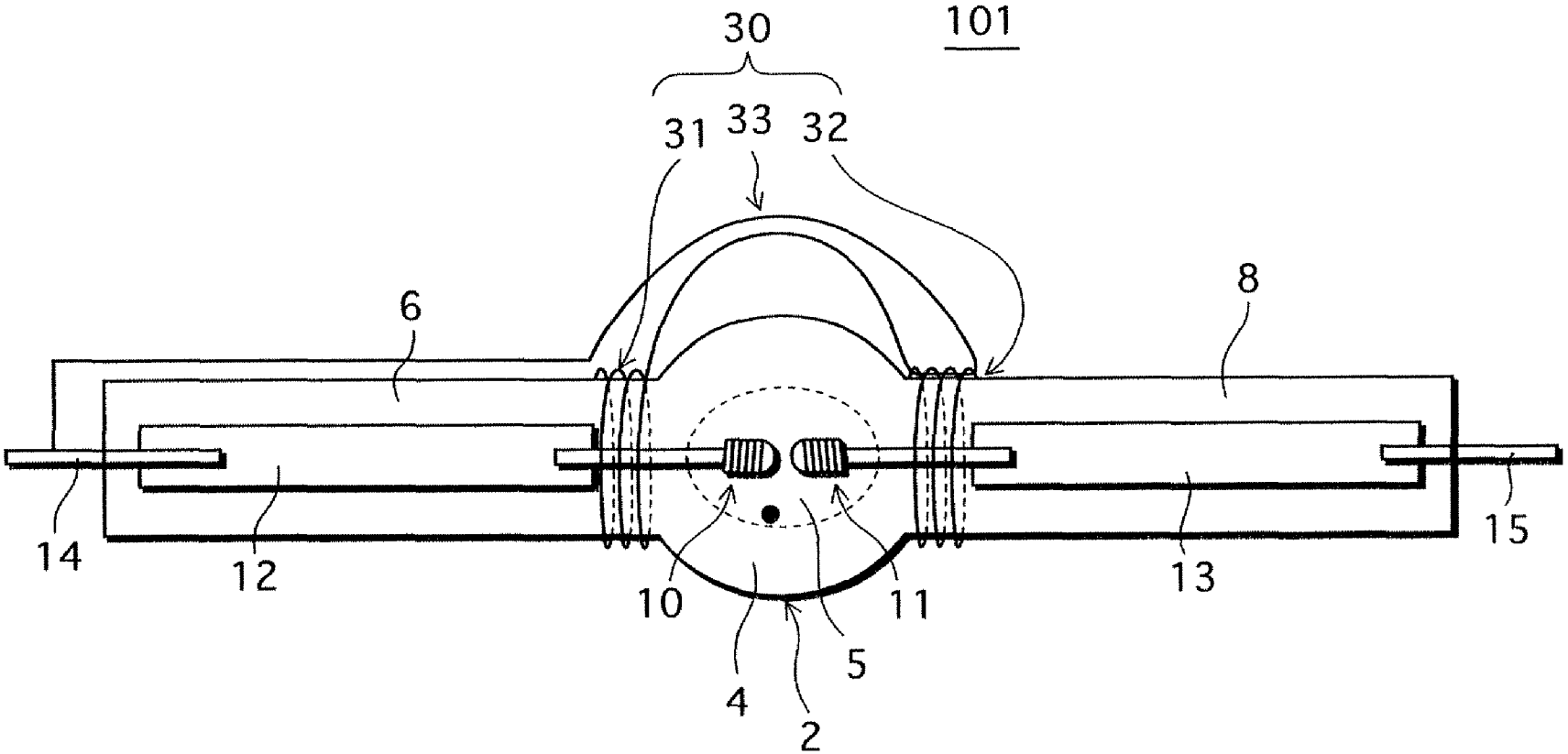
FIG. 5 shows an overall structure of a high-pressure mercury lamp 101 (rated power: 110 W) pertaining to the second embodiment.

FIG. 5 shows an overall structure of a high-pressure mercury lamp 101 (rated power: 110 W) pertaining to the second embodiment.

In FIG. 5, the same components as in the high-pressure mercury lamp 100 pertaining to the first embodiment are referred to by the same numbers, and the explanations thereof are omitted here.

On the outer surface of the arc tube 2, a conductor 30 is disposed.

The conductor 30 includes winding parts 31 and 32 formed by winding a lead around the both sealing parts 6 and 8, near the light emitting part 4. Each of the winding parts 31 and 32 is a coil formed by spirally winding a lead three times.

The winding part 31 is connected with a lead 33. The lead 33 detours around the outer surface of the light emitting part 4, reaches to the second sealing part 8, and then turns back through the spiral winding part 32 with keeping contact with the winding part 32. Then, the lead 33 detours around the outer surface of the light emitting part 4 again, reaches to the first sealing part 6, and is connected with the external lead 14. Note that the winding part 32 is prevented by the lead 33 from moving in the direction to the second sealing part 8.

This embodiment also can cool down the electrode base parts by the radiation effects of the winding parts 31 and 32, and gather the mercury around the electrode base parts.

Comparison Test

The following explains results of a test for comparing the lamp lives and the breakdown voltages of the lamp 101 pertaining to the second embodiment and a conventional lamp.

Figure 6:
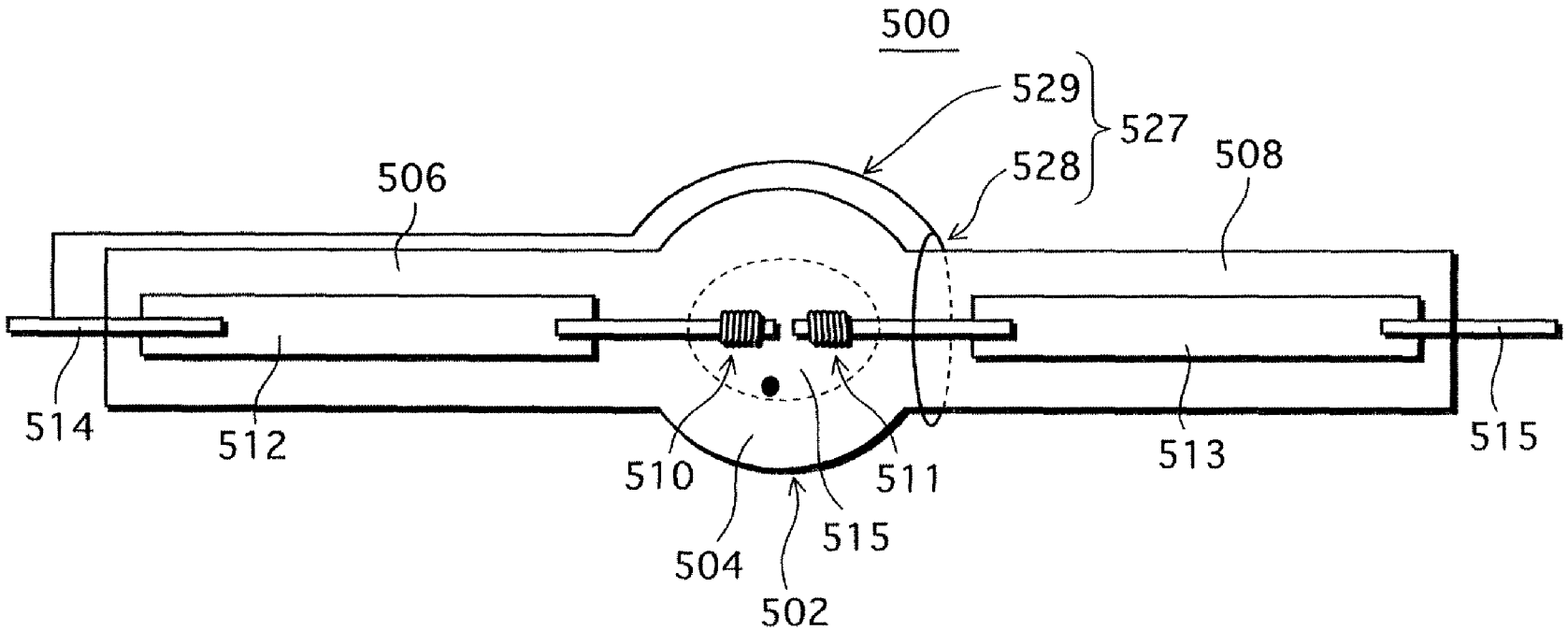
FIG. 6 shows a lamp 500 (rated power: 110 W) having a conventional structure.

FIG. 6 shows a lamp 500 (rated power: 110 W) having a conventional structure, which was used in this comparison test.

On the outer surface of an arc tube 502, a proximity conductor 527 is disposed. The proximity conductor 527 includes a winding part 528 and a lead 529. The winging part 528 has a closed-loop structure and is wound once around the sealing part 508 near the light emitting part 504. The lead 529 passes near the light emitting part 504, and connected with an external lead 514. The other components included in the lamp 500 are the same as in the lamp 100 (see FIG. 1). Accordingly, the same components are referred to by numbers having the same lower two digits as in the lamp 100, and explanations thereof are omitted here.

FIG. 7A is a table showing results of a lamp life test. In this life test, three conventional lamps 500 with a rated power of 110 W and a new-type lamp 101 were used, and each of them was turned on for 3.5 hours and turned off for 1.5 hours in cycles. Each of the specifications (the volume of the light emitting part, the amount of the enclosed mercury and rare gasses, and the electrode gap distance) of the lamps 500 and 101 are the same.

As the table of FIG. 7A shows, the lamps are evaluated by checking the degree of the blackening in the arc tube with eyes, and lamps in which the blackening was not observed are indicated by a sign "○", lamps in which the blackening was partially observed are indicated by a sign "Δ", and lamps in which a terrible blackening was observed is indicated by a sign "X".

As FIG. 7A shows that the blackening that occurs in the lamp 101 based on the new specifications pertaining to the second embodiment due to a long-time lighting is reduced compared to the conventional lamp 500.

FIG. 7B is a table showing results of a breakdown voltage measuring test. In this measuring test, twenty lamps were prepared, and as to each of the lamps, the breakdown voltage at the time when a prescribed high-frequency voltage was applied to the lamp to start the discharge was measured. The average (Ave.) of the breakdown voltage of the lamp 101 based on the new spec is suppressed to be lower than that of the conventional lamp 500.

Modification Example

While the high-pressure mercury lamp is turned on, the temperature of the outer surface of the arc tube 2 becomes high. This degrades the lead of the winding parts in some cases.

In particular, if the winding parts are wound many times, the adverse effect of the degradation of the lead of the winding parts becomes remarkable. Accordingly, it becomes difficult for the high-voltage pulse applied at the start-up, to reach at the tips of the winding parts. This results in loss of the effect of reducing the breakdown voltage, and the lamp does not turn on in some cases. Given this, the following modification may be applied.

Figure 8:
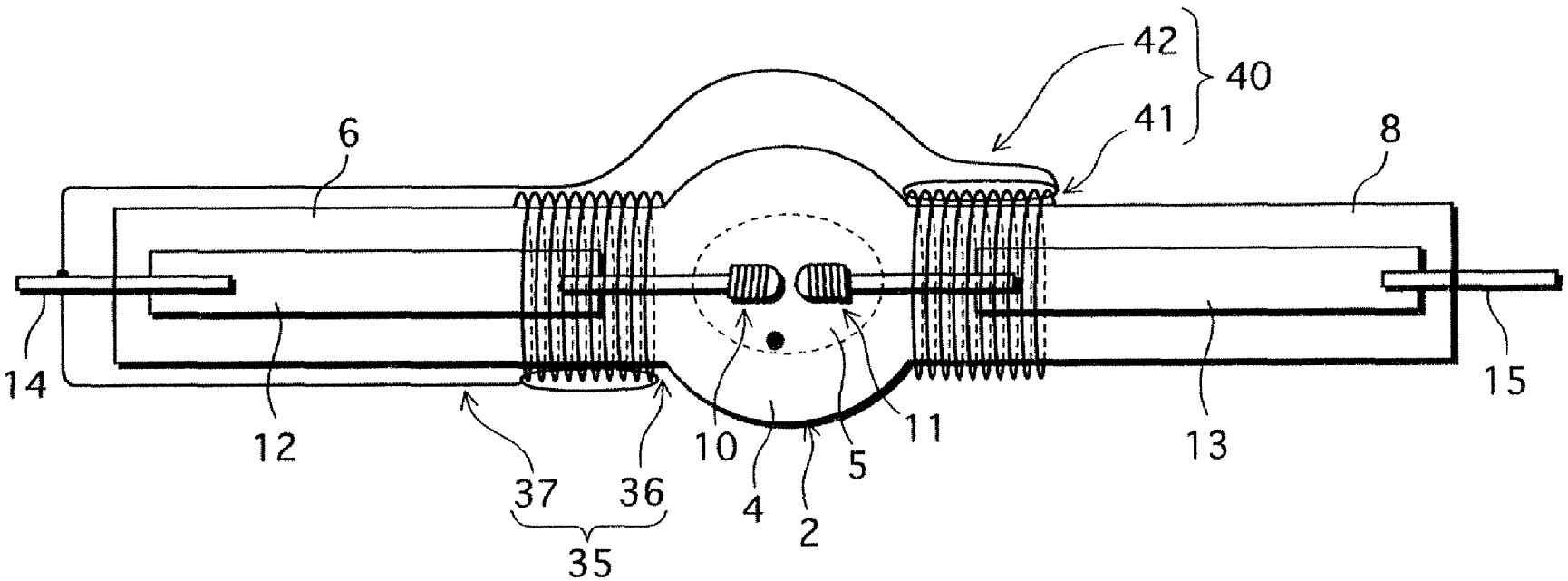
FIG. 8 shows an overall structure of a high-pressure mercury lamp 102 pertaining to a modification example.

FIG. 8 shows an overall structure of a high-pressure mercury lamp 102 pertaining to a modification example.

Conductors 35 and 40 include coil parts 36 and 41 and leads 37 and 40 respectively. Each of the coil parts is formed by winding a lead wire a prescribed number of times.

The leads 37 and 42 respectively have parts around which the coil parts 36 and 41 are to be wound, which extend in the direction perpendicular to the winding direction of the coil parts 36 and 41 (i.e. the tube axis direction of the arc tube 2). In such a manner, the coil part 36 and the lead 37, and the coil part 41 and the lead 42 are respectively capacitive-coupled by connecting the winding start point and the winding end point of each of the coil parts 36 and 41, so that the transmission error of the high-voltage pulse is prevented.

Third Embodiment

In the third embodiment, a liquid collecting member is provided for collecting the mercury gathering around the electrode base parts after the lamp is turned off. As a result, as much mercury as possible is collected at the electrode base parts until the lamp is turned on the next time, and this prevents the blackening of the arc tube due to the base discharge.

Figure 9:
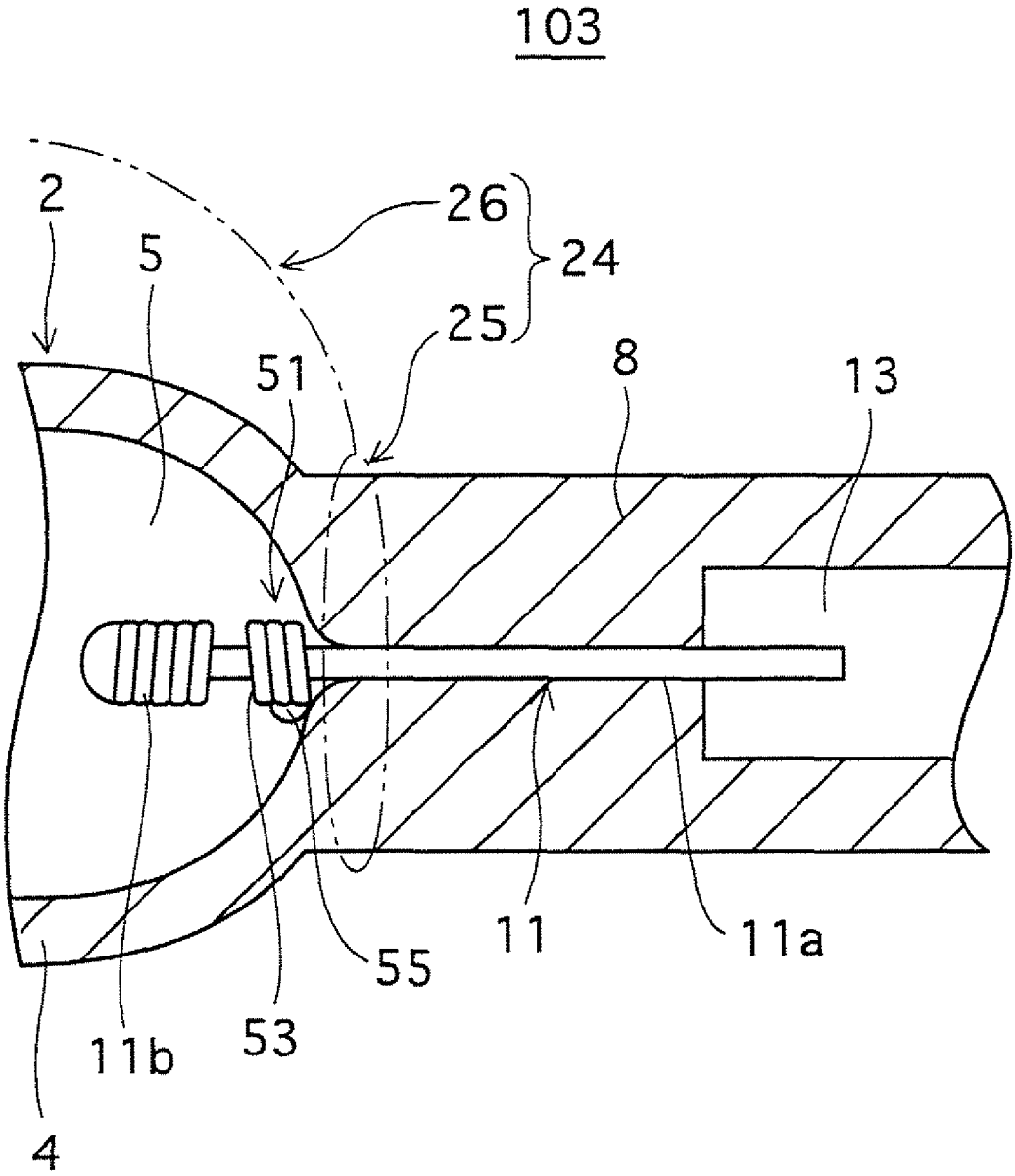
FIG. 9 is an enlarged view of an electrode base part pertaining to the third embodiment.

FIG. 9 is an enlarged view of an electrode base part pertaining to the third embodiment. Since the structure of a lamp 103 pertaining to the third embodiment is basically the same as the structure of the lamp 100 pertaining to the first embodiment, the same components are referred to by the same numbers, and explanations thereof are omitted here. Note that although FIG. 9 only shows the second electrode 11, the other electrode, namely the first electrode 10 also has the same structure. The electrode 11 includes an electrode rod 11*a* and an electrode coil 11*b* disposed at the tip of the electrode rod 11*a*.

A liquid collecting member 51 for collecting liquefied mercury is provided at the base part of the electrode 11, where the liquefied mercury is generated as the mercury vapor accumulates at the base part and is cooled after the lamp is turned off. The liquid collecting member 51 is, in the present embodiment, a coil 53 that is made by winding a wire plural times (in the present embodiment, substantially three times). Note that the coil 53 is hereinafter referred to as the liquid collecting coil 53.

The liquid collecting coil 53 is formed of a wire that is made of the same material (e.g. tungsten) as the electrode rod 11*a*. The liquid collecting coil 53 is fixed to each of the electrode rod 11*a* by directly winding a wire around the electrode rod 11*a* or by welding a coil, which has been wound already, to the electrode rod 11*a*.

The electrode 11 (namely the base part thereof) is connected to the outside via the metal foil 13 and the external lead 15 (see FIG. 1). Since they are made of materials having high thermal conductivity, the base part is the most promptly cooled down among the portions within the discharge space 5 after the lamp is turned off, which causes mercury to easily gather at the electrode base part.

In the lamp 103 having the stated structure, the mercury vapor, which has gathered in the area whose temperature falls the most immediately after the lamp is turned off, adheres to the liquid collecting coil 53. Then, as the temperature further falls, the vapor mercury, which has adhered to the liquid collecting coil 53, becomes liquid and is collected by the liquid collecting coil 53. Liquefied mercury 55 adheres to the surface of the liquid collecting coil 53 by the surface tension, or intrudes into a gap between the liquid collecting coil 53 and the electrode rod 11*a*, or intrudes into gaps in the wire wound three times, by capillary action.

As described above, the lamp 103 pertaining to the third embodiment can hold more mercury in the vicinities of the electrode base parts.

During the base discharge at the start of the lighting, the mercury 55 held in the vicinities of the electrode base parts is evaporated. Therefore, the lamp 103 can prevent that the electrode 11 (and the liquid collecting coil 53) evaporate in large quantity and cause the blackening.

Note that as long as the liquid collecting coil can collect the liquefied mercury, which is generated as the mercury vapor accumulates at the electrode base parts and is liquefied after the lamp is turned off, and can store the liquefied mercury without allowing it to drop, the liquid collecting coil is not limited specifically in terms of: diameter of the wire used for the coil; shape of the wire; diameter of the coil; the number of turns of the coil; the number of overlapping turns of the coil; measurement or the like. Also, the liquid collecting member is not limited to a coil in shape, but may be any member in different shapes.

Other Modifications (1) In the embodiments above, the present invention is explained by taking a high-pressure mercury lamp as an example of high-pressure discharge lamps. However, the present invention is applicable to other types of high-pressure discharge lamps, such as metal halide lamps.

INDUSTRIAL APPLICABILITY

The high-pressure discharge lamp of the present invention is capable of preventing a short lamp life due to a base discharge generated at the start of lighting, and contributing to reduction in size and weight of lamp lighting apparatuses.

The invention claimed is:

1. A high-pressure discharge lamp comprising:

a light emitting part having therein a discharge space;

first and second sealing parts respectively disposed at both ends of the light emitting part;

first and second electrodes respectively extending from the first and second sealing parts into the discharge space;

a first winding part formed by winding a first conductive lead around the first sealing part, the first conductive lead being electrically connected to the first electrode;

a second winding part formed by winding a second conductive lead around the second sealing part; and a lead wire that is electrically connected to and extends from the second winding part, detours around the light emitting part, and is connected to the first conductive lead.

2. The high-pressure discharge lamp of claim 1, wherein at least one of the first winding part and the second winding part is a coil.

3. The high-pressure discharge lamp of claim 2, wherein a portion from a winding start to a winding end of the coil is capacitive-coupled to the lead wire.

4. The high-pressure discharge lamp of claim 1, further comprising a holding member that is disposed on at least one of base parts of the first and second electrodes within the discharge space, and operable to hold mercury that gathers in a vicinity of the at least one of the base parts after the lamp is turned off.

5. The high-pressure discharge lamp of claim 4, wherein the holding member is fixed to the at least one of the base parts.

6. A lamp unit, comprising:

the high-pressure discharge lamp defined in claim 1; and a reflecting mirror that reflects light emitted from the high-pressure discharge lamp.

7. An image display apparatus comprising the high-pressure discharge lamp defined in claim 1.

* * * * *